US005678519A

United States Patent [19]

Nakamura

[11] Patent Number: 5,678,519

[45] Date of Patent: Oct. 21, 1997

[54] ENGINE CONTROL SYSTEM

[75] Inventor: Kazuhiro Nakamura, Hamamatsu, Japan

[73] Assignee: Sanshin Kogyo Kabushiki Kaisha, Hamamatsu, Japan

[21] Appl. No.: 639,836

[22] Filed: Apr. 19, 1996

[30] Foreign Application Priority Data

Apr. 19, 1995 [JP] Japan ..... 7-119146

[51] Int. Cl.[6] ..... F02P 5/02

[52] U.S. Cl. ..... 123/413

[58] Field of Search ..... 123/413, 422, 123/423, 146.5 A, 149 C, 149 D, 602

[56] References Cited

U.S. PATENT DOCUMENTS 4,606,314 8/1986 Yamazaki ..... 123/413
4,986,239 1/1991 Oishi ..... 123/413
5,062,403 11/1991 Breckenfeld et al. ..... 123/413
5,076,233 12/1991 Nelson et al. ..... 123/413
5,159,916 11/1992 Isogawa ..... 123/413
5,273,016 12/1993 Gillespie et al. ..... 123/413
5,582,149 12/1996 Kanno ..... 123/413
5,606,952 3/1997 Kanno et al. ..... 123/413

*Primary Examiner*—Willis R. Wolfe
*Attorney, Agent, or Firm*—Knobbe, Martens, Olson & Bear LLP

[57] ABSTRACT

Several embodiments of engine control systems that require a throttle position signal. The throttle position signal is derived from a computation made utilizing information derived from the linkage system that interconnects the throttle and spark timing controls.

21 Claims, 7 Drawing Sheets

ENGINE CONTROL SYSTEM

BACKGROUND OF THE INVENTION

This invention relates to an engine control system and more particularly to an improved and simplified arrangement for sensing certain engine parameters for engine control.

In an effort to improve the performance of an engine, various control strategies have been proposed that sense a number of engine and ambient conditions and control the engine in response to these sensed conditions. Such controls are very effective in providing good fuel economy, exhaust emission control and maintaining good drivability and engine performance. Unfortunately, the sensors associated with these control systems not only add to the cost of the engine, but may at times present some difficulties.

For example, it is normally the practice to employ a form of throttle position sensor so as to provide a signal indicative of the throttle position of the engine. The throttle position sensor is important in providing necessary data for the engine control. For example, throttle position is a good indication of operator demand and/or load.

The type of throttle position sensors normally employed utilize potentiometers that are connected to the throttle valve shaft and which provide an electrical analog signal indicative of the throttle position. These sensors tend to become expensive, require electrical connections and, if defective, may actually interfere with the throttle operation.

In addition to providing a signal indicative of engine load, the throttle position sensor also may be utilized for other purposes. For example, many forms of engine control employ a device which disables the firing of one or more cylinders under some conditions. This cylinder disabling is done to maintain a desired speed or prevent over-speed of the engine for a variety of purposes.

However, if the throttle valve is set at a low position and the cylinders are disabled, the engine may then stall and restarting may be difficult, if not impossible. Therefore, these systems normally require a throttle position sensor so that the cylinder disabling will not occur when the throttle valve is open less than a predetermined amount. Thus, the aforenoted potential problems exist.

It is, therefore, a principal object of this invention to provide an improved engine control that can determine throttle valve position without utilizing a throttle valve sensor, per se.

It is a further object of this invention to provide an improved method and apparatus for determining position of a throttle valve of an engine for engine control without necessitating the use of an actual throttle valve sensor.

It is a further object of this invention to provide an engine control system having certain sensors for sensing certain engine characteristics and wherein the output of these sensors may be utilized to determine throttle position even though the sensors are not directly associated with the throttle valve. Thus, the cost of the system can be significantly reduced without sacrificing any of the performance.

SUMMARY OF THE INVENTION

This invention is adapted to be embodied in an engine control and control method for an internal combustion engine having at least one combustion chamber. An induction system is provided for delivering a charge to the combustion chamber. A throttle valve is provided in the induction system for controlling the flow therethrough in response to operator demand. A spark plug is provided for firing a charge in the combustion chamber. An engine output shaft is driven by the combustion in the combustion chamber. An ignition system is provided for firing the spark plug and this ignition system includes a pulser coil juxtaposed to the engine output shaft for providing a triggering pulse for the ignition system. A spark control means comprising a linkage system is provided for rotatably moving the pulser coil about the axis of rotation of the engine output shaft in relation to the position of the throttle valve for changing spark timing in response to throttle position.

In accordance with an apparatus for practicing the invention, means are provided for calculating the angular position of the throttle valve from the position of the pulser coil.

In accordance with a method for practicing the invention, the throttle valve position is calculated by utilizing the location of the pulser coil.

DETAILED DESCRIPTION OF THE PREFERRED EMBODIMENTS OF THE INVENTION

Figure 1:
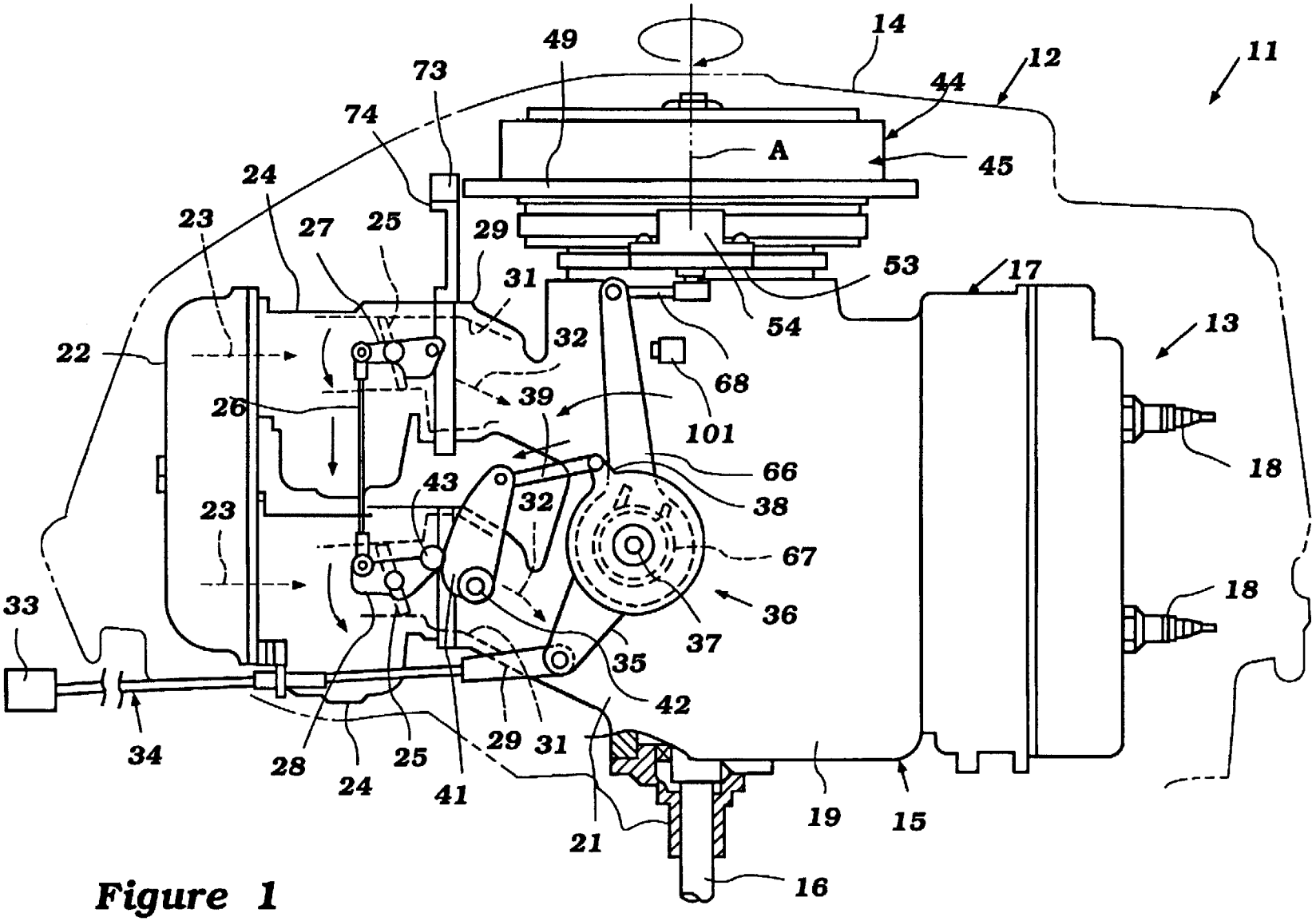
FIG. 1 is a side elevational view of a portion of an outboard motor constructed and operated in accordance with an embodiment of the invention, with portions of the protective cowling being shown in phantom and other portions being broken away and shown in section.
Figure 2:
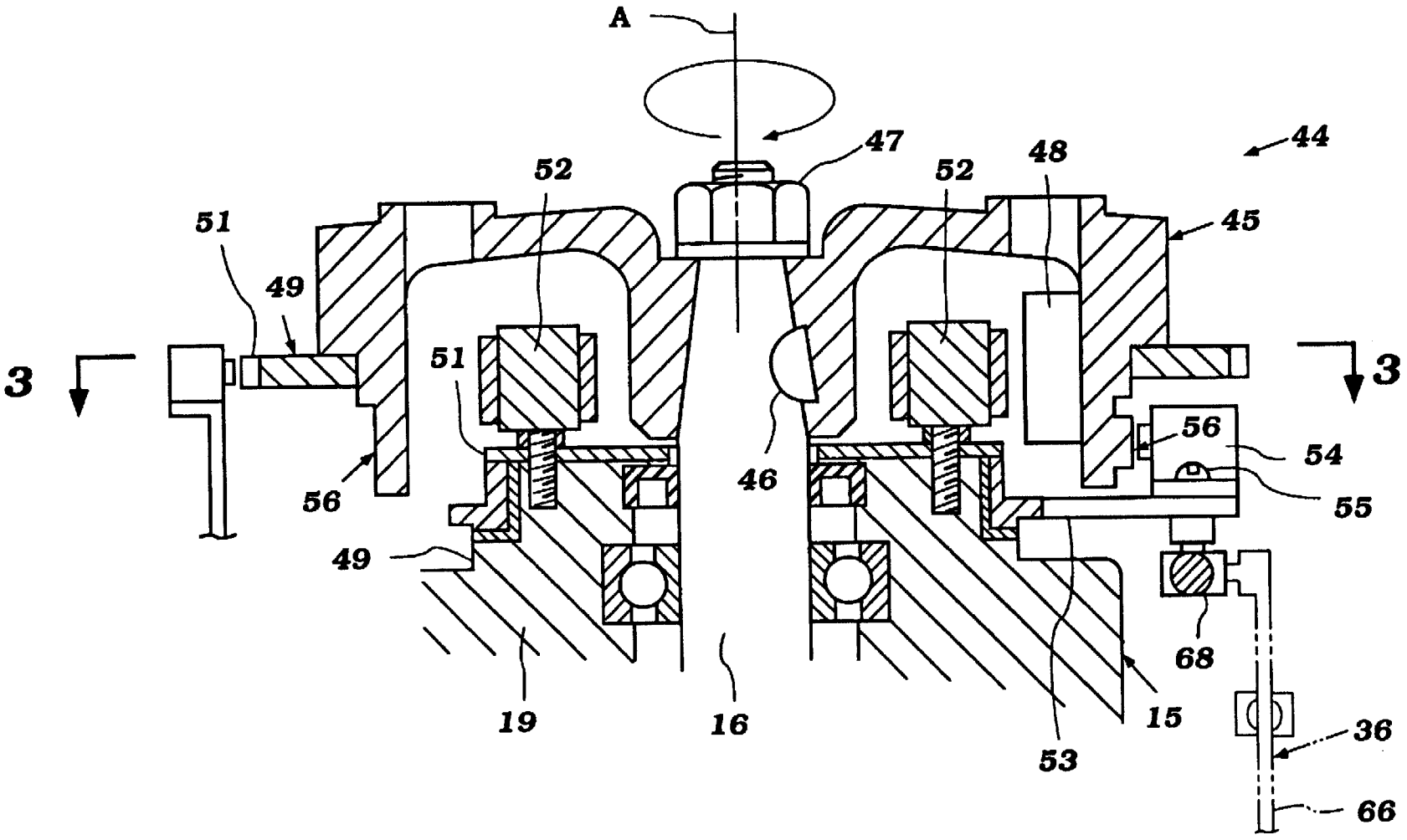
FIG. 2 is an enlarged cross-sectional view, looking in the same direction as FIG. 1 and showing the flywheel magneto assembly and the crankshaft timer sensors.

Referring first to FIGS. 1 and 2, an outboard motor constructed in accordance with an embodiment of the invention is illustrated partially and is identified generally by the reference numeral 11. The invention is described in conjunction with an outboard motor because outboard motors frequently utilize systems wherein the throttle control and spark control are mechanically interrelated and, thus, facilitate the determination of the throttle angle without utilizing a throttle angle sensor. It will be readily apparent, however, from the following description how the invention can be practiced in a wide variety of other types of engine applications.

The outboard motor 11 includes a power head 12 that is comprised of a powering internal combustion engine, indicated generally by the reference numeral 13 and a surrounding protective cowling which is shown in phantom in this figure and which is identified by the reference numeral 14.

Since the invention, as should be apparent from the foregoing description, deals primarily with the engine 13 and the control therefor, the remaining components of the outboard motor 11 are not illustrated nor is a description of them believed to be necessary. Where any components of the outboard motor 11 are not illustrated or described, they may be considered to be conventional.

In the illustrated embodiment, the engine 13 is depicted as being of the two-cylinder, in-line, crankcase compression type. Although the invention is described in conjunction with such an engine, it should be readily apparent to those skilled in the art how the invention can be utilized with engines having other cylinder numbers, other cylinder configurations, and engines operating on other than the two-stroke principle. In fact, certain facets of the invention may also be practiced with rotary-type engines.

The engine 13 is comprised of a cylinder block 15 that has a pair of cylinder bores which are in-line and which have their axes extending in a horizontal direction, as is typical with outboard motor engine practice. Because of this, the engine crankshaft 16 will rotate about a vertically extending axis. This facilitates coupling of the engine output shaft 16 to the drive shaft (not shown) which depends into the drive shaft housing to drive the propulsion unit of the outboard motor.

A cylinder head assembly 17 is affixed to the cylinder block 15 in a known manner and closes the cylinder bores of the cylinder block as is well known in this art. Spark plugs 18 are mounted in a known manner in the cylinder head 17 and are fired by the ignition circuit, which will be described in more detail later, so as to fire the charge in the combustion chambers of the engine.

The cylinder block 15 is comprised of a main cylinder block body 19 which has a crankcase member 21 fixed to it and which defines a crankcase in which the crankshaft 16 is rotatably journaled in any known manner. As is typical with two-cycle engine practice, the crankcase chamber is divided into a plurality of sealed sections each of which cooperates with a respective one of the cylinder bores.

An induction and charge forming system is provided for supplying a fuel air charge to these crankcase chamber sections. This induction system includes an air inlet device 22 that receives atmospheric air that has been admitted into the protective cowling 14 through an atmospheric air inlet opening. Air flows in the direction as indicated by the arrows 23 from the air inlet device 22 into a pair of carburetors 24. In the illustrated embodiment, the charge forming system incorporates such carburetors, but it will also be readily apparent to those skilled in the art how the invention may be utilized in conjunction with engines having other types of charge forming systems.

Each carburetor 24 has rotatably journaled in its respective induction passage a throttle valve 25. The throttle valves 25 of each of the carburetors 24 are mounted on respective throttle valve shafts. These throttle valve shafts are interconnected for simultaneous movement by a synchronizing link 26. The link 26 is connected to the throttle valve shaft of the upper or slave carburetor 24 through a throttle actuating arm 27. The lower end of the link 26 is pivotally connected to a throttle actuating lever 28 that is affixed to the throttle valve shaft of the lower most carburetor 24 in a known manner. The operating system for controlling the throttle valves 25 will be described later.

The charge which has been formed by the carburetors 24 is delivered to a pair of intake manifolds 29 each of which has a respective runner 31 that delivers the charge to the crankcase chamber sections in the direction shown by the arrows 32. Although not shown in the figures, reed-type check valves are provided in the runners 29 at the respective intake ports serving the crankcase chamber sections so as to permit this charge to flow into the crankcase chambers when the pistons are moving upwardly. These reed-type check valves will close as the pistons move downwardly to permit the charge to be compressed in the crankcase chambers and then transferred through the scavenging system to the combustion chambers for further compression therein.

The throttle actuating mechanism will now be described by continued referenced primarily to FIG. 1. There is provided a remotely located throttle actuator 33 which is juxtaposed to the watercraft operator and which is connected by means of a bowden wire cable 34 to a lever 35 of a combined throttle and spark control mechanism, indicated generally by the reference numeral 36.

The lever 35, as well as certain other components, which will be described, are rotatably journaled on the engine body 19 by a pivot bolt 37. The lever 35 forms a portion of a bell crank that has a further lever arm 38. The lever arm 38 is pivotally connected to one end of a throttle cam link 39. The other end of the throttle cam link 39 is pivotally connected to a throttle valve actuating cam 41. The cam 41 is journaled on one of the manifolds 29 by a pivot bolt 42 and has a cam surface. This cam surface is engaged with a follower member 43 provided on the throttle actuating lever 28 so that, when the throttle actuating mechanism 36 is rotated in a counterclockwise direction as shown by the arrow in FIG. 1, the cam 41 will be rotated in a counterclockwise direction and cause the throttle actuating link 28 also to be rotated in a counterclockwise direction so as to open the throttle valve 25 of the lower carburetor 24. As has been noted, the synchronizing link 26 will affect light movement Of the throttle valve 25 of the upper carburetor 24.

Figure 3:
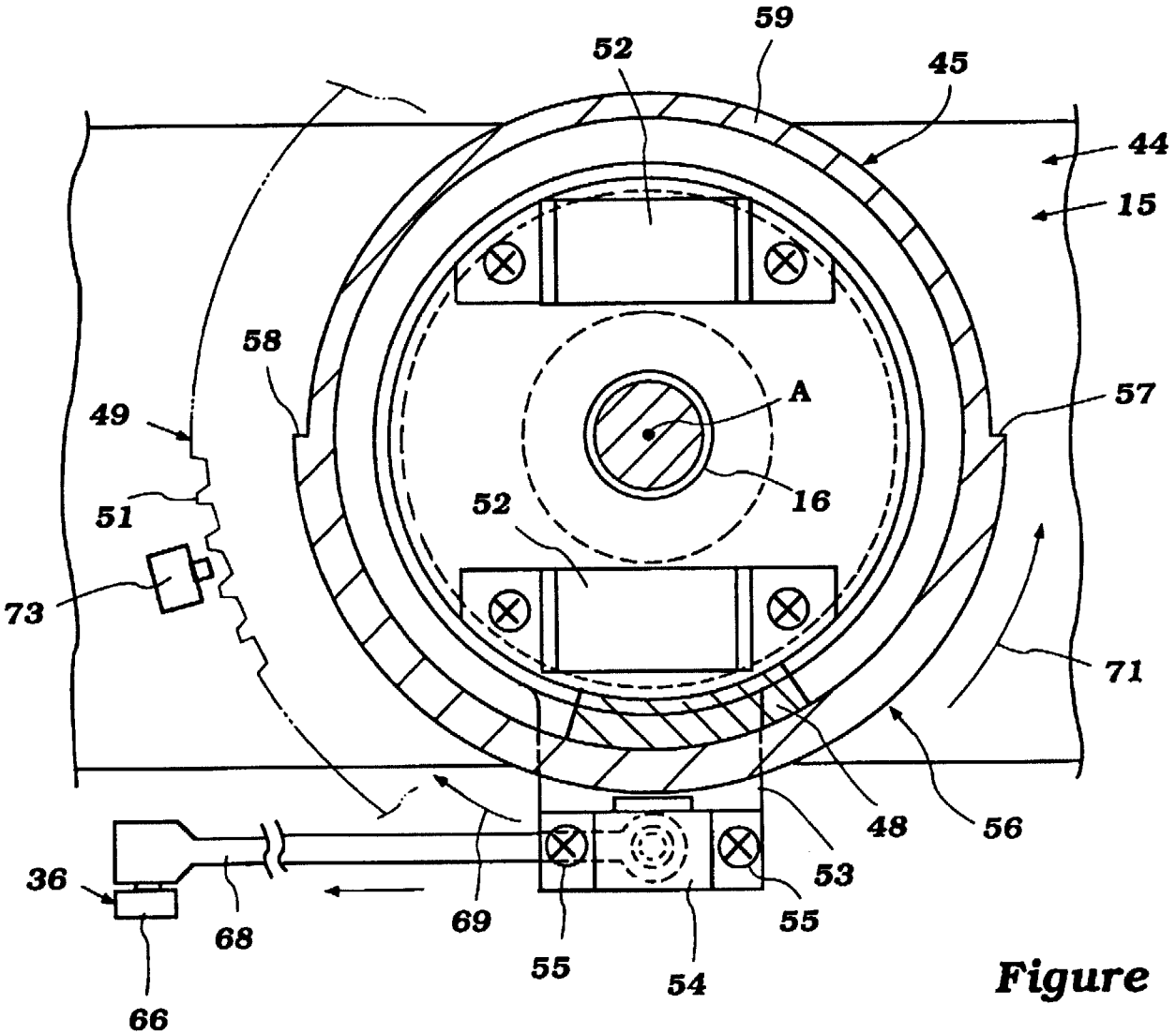
FIG. 3 is a cross-sectional view taken along the line 3—3 of FIG. 2 and shows the interrelationship of the coils.

The ignition system for firing the spark plugs 18 and which provides an additional feature as will become apparent will now be described by reference primarily to FIGS. 1–3. This ignition system includes a flywheel magneto assembly, indicated generally by the reference numeral 44. This flywheel magneto assembly 44 includes a flywheel, indicated generally by the reference numeral 45 which is affixed to the upper end of the crankshaft 16 by a retaining key 46 and nut 47. The flywheel 45 carries one or more permanent magnets 48 which are spaced around its inner circumference. Affixed to the outer periphery of the flywheel 45 is a starter gear 49 having individual teeth 51 which are engaged by a starter motor (not shown) for electrical starting of the engine 13 in a manner well known in this art.

As may be best seen in FIG. 2, the crankshaft 16 extends through the upper end of the engine block where the flywheel 45 is affixed to it. This end of the engine block 19 is formed with a generally cylindrical projection 49 on which is mounted a supporting plate 51 that carries a plurality of charging coils 52. The charging coils 52 cooperate with the permanent magnets 48 and provide a source of electrical power for the ignition system for firing the spark plugs 18. The ignition system may be of any known type, such as a CDI-type of ignition system. Since the ignition system, per se, forms no part of the invention, it will not be described in further detail. Those skilled in the art can readily refer to the prior art for any type of ignition system with which the invention can be utilized.

Supported beneath the plate 51 on the engine cylinder block portion 49 is a timer ring 53. This timer ring 53 has an arm portion that carries a pulser coil 54. The pulser coil 54 is held in a fixed relation on this timer ring 53 by threaded fasteners 55.

The flywheel 45 is provided with a surface portion, indicated generally by the reference numeral 56, which is formed below the starter gear 49 and which has a pair of surface discontinuities 57 and 58. These discontinuities 57 and 58 are formed by a smaller diameter section 59 of this portion of the flywheel 45. These sections are displaced from each other at an angle which is equal to the offset angle between the top dead center positions of the pistons associated with each of the cylinder bores.

Hence, when these surface discontinuities 57 and 58 pass the pulser coil 54, there will be generated a pulse signal. This pulse signal may be seen from the graphical view of FIG. 5 which shows the pulse spikes S1 and S2 that are generated each time one of the discontinuities 57 and 58 pass in proximity to the pulser coil.

Figure 5:
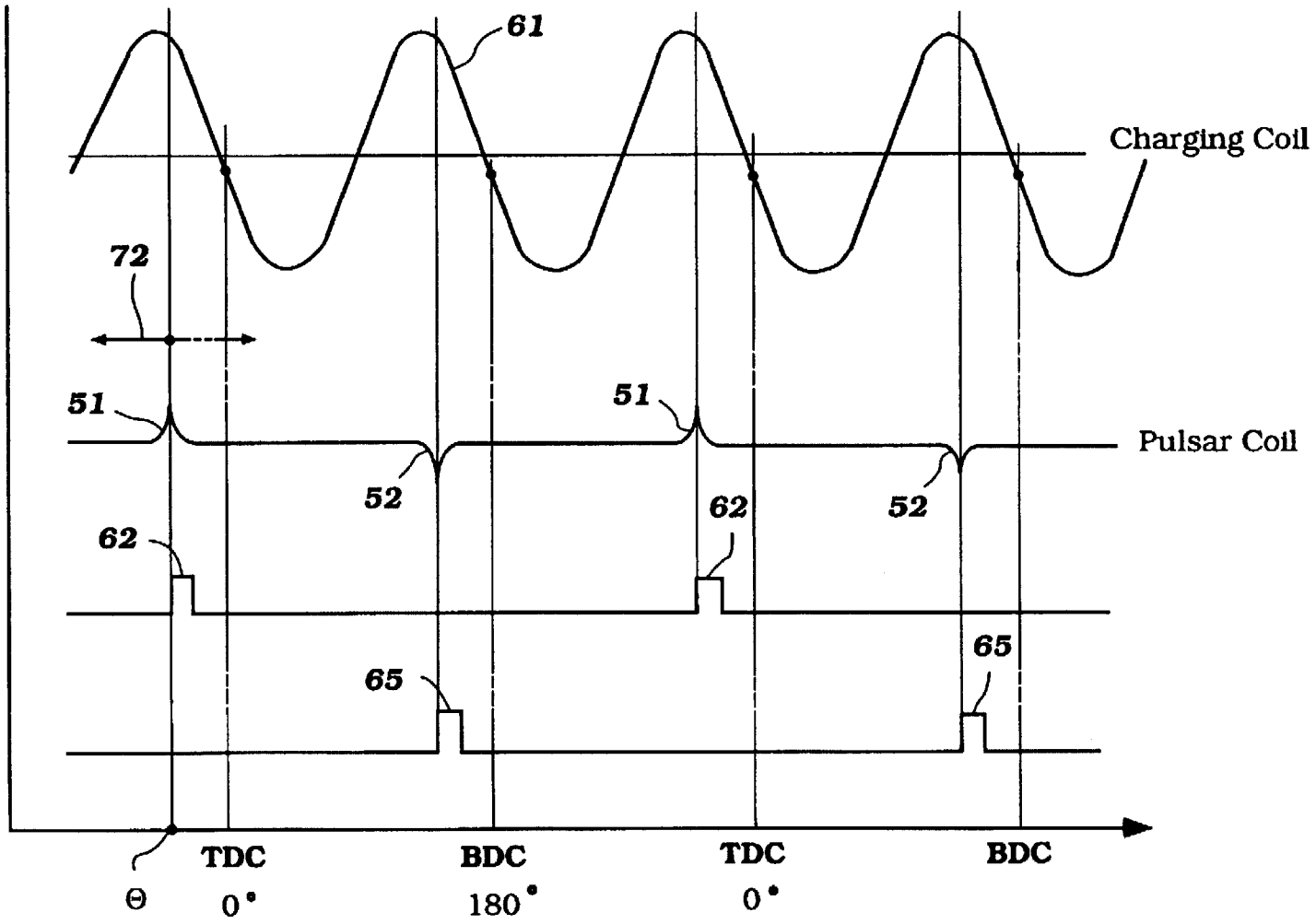
FIG. 5 is a graphical view showing the charging coil power output, pulser coil trigger signals and ignition timing of the two cylinders of the engine for two crankshaft revolutions.

The output of the charging coil or coils 52 is indicated by the sinusoidal curve 61 at the top of FIG. 5. The positive pulses S1 from the pulser coil are utilized by the ignition circuit to trigger an output pulse 62 for firing the spark plug 18 associated with number 1 cylinder. The negative pulses S2 at the pulser coil 54 are utilized to trigger output pulses 65 utilized by the ignition circuit to fire the spark plug 18 associated with cylinder number 2. The initial setting of the timer ring 53 is at an angle indicated at 0 in FIG. 5 and this is initial timing or spark advance for firing of the spark plugs 18. This initial position can obviously be set in any known manner.

The engine 13 is also provided with a mechanism wherein the spark is advanced as the load on the engine increases and as the speed increases. This is done by the throttle and timing control mechanism 36 and will be described by continuing reference to FIGS. 1–3.

The throttle and timing control mechanism 36 includes a further lever arm portion 66 which is normally biased for rotation with the throttle lever 35 by means of a torsional spring 67 that is loaded therebetween. This mechanism is provided so that the spark will be advanced linearly up to a certain throttle opening. Thereafter, the spark advance may be held at this fixed amount by providing an adjustable stop for the spark control lever 66. This may or may not be done depending upon the particular engine characteristics.

In any event, if such a stop is utilized, the throttle lever 35 can continue to rotate while the spark advance lever 66 will be held against further rotation so as to set the maximum spark advance. This is done at fairly wide open throttle settings, if at all.

The spark control lever 66 is pivotally connected at its upper end to one end of a spark control link 68. The other end of the link 68 is pivotally connected to the timer ring 53. Hence, as the throttle linkage is moved to open the throttle valves 25 in the direction of the arrows shown in FIG. 1, the timer ring 53 and pulser coil 54 will be rotated about the axis A of rotation of the crankshaft 16 in a direction indicated by the arrow 69 in FIG. 3 which is opposite to the rotation direction 71 of the crankshaft 16. As a result, the time when the trigger pulses S1 and S2 are generated will be advanced as shown by the arrow 72 in FIG. 5. Hence, a linear spark advance is achieved upon progressive opening of the throttle valve.

The mechanism as thus far described may be considered to be conventional. That is, the type of mechanism which has been described is that which is normally utilized for controlling the spark advance in engines. However, there are other additional controls for the engine management system, and one of these will be described later, which require a signal that is indicative of the actual position of the throttle valves 25. Normally, throttle position sensors are utilized to achieve this function. In accordance with this invention, however, an accurate indication of throttle position is generated in the manner which will now be described and which dispenses with the need and cost for separate throttle position sensors.

Figure 6:
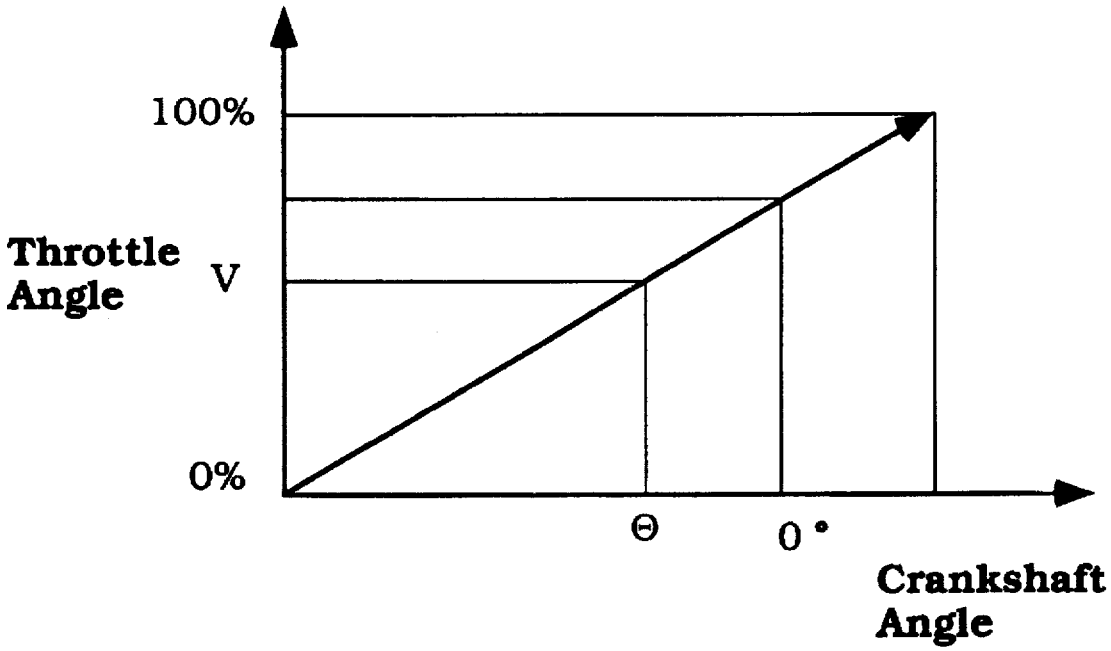
FIG. 6 is a graphical view showing the relationship of throttle angle to angular rotation of the crankshaft to explain how the throttle angle position can be determined from the crankshaft position sensors.

In accordance with a first embodiment of the invention, a further pulser coil, indicated generally by the reference numeral 73 is mounted in proximity to the teeth 51 of the starter gear 49. This pulser coil 73 may be mounted on a mounting bracket 74 that is fixed to the uppermost intake manifold 29. This pulser coil 73 will output a pulse each time a tooth 53 passes it. Therefore, this pulse signal will provide an indication of the angular position of the crankshaft 16. Therefore, by measuring this angular position and the timing of the pulses S1 and S2, it is possible to measure the actual angle that the timing plate 53 has been rotated in the direction of the arrow 69. Since this angle is directly related to the angle of movement of the throttle valve 25, as seen in FIG. 6, the actual throttle angle position can be determined relative to the angular rotation of the timing plate 53. Therefore, the ECU for controlling the engine can be programmed so as to make this computation and provide a signal that is directly indicative of throttle angle for such engine controls as may be desired. As has been noted, one of these engine controls will be described.

Figure 4:
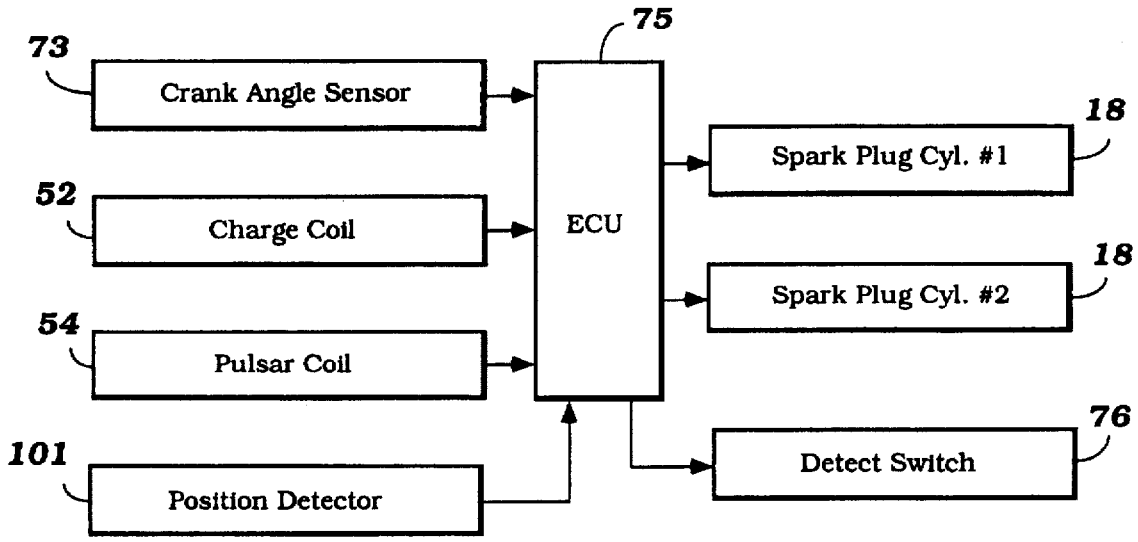
FIG. 4 is a block diagram showing the interrelationship of the various elements utilized for controlling the spark timing and determining the throttle angle position.

FIG. 4 shows how the various components are related and this indicates the ECU for the engine management system, which ECU is indicated generally by the reference numeral 75. As may be seen, the outputs from the crank angle sensor 73 and the pulser coil 54 are inputted to the ECU 75 and are utilized by it in its controlling of the firing of the spark plugs 18. Also, the output of the charging coil is employed for generating the electricity to fire the plugs.

The applicability of the position sensing capabilities of being able to determine the position of the throttle valve 25 will now be described by particular reference to a type of control routine which is employed commonly in engines. This is to provide the so-called "limp home" mode of operation. If the engine experiences a situation which can be dangerous, rather than completely disabling the engine, the engine is operated in a manner so that the speed at which the engine can be operated is reduced. One way this is done is by misfiring of the spark plugs 18.

In this way, the operator of the vehicle propelled by the engine can reach an area where repairs can be made without being stranded. Such devices can operate in response to either low oil temperature, low cooling water availability, etc. Therefore, the engine utilizing this system has a switch, shown schematically at 76 which is normally on when the engine condition is proper and is turned off when the engine condition is abnormal. Thus, if the dangerous condition exists, the output of the switch 76 will be off.

However, these systems that operate on the limp-home mode operate so as to avoid disabling the cylinders when the throttle valve is not fully opened, but is at a low-speed or idle condition. If cylinder disabling were done under these conditions, the engine might stall, and restarting might be difficult. Therefore, these systems normally require an output from a throttle position sensor. However, because of this arrangement it is not necessary to employ the throttle position sensor because the throttle position can be determined in the aforenoted mode.

Figure 7:
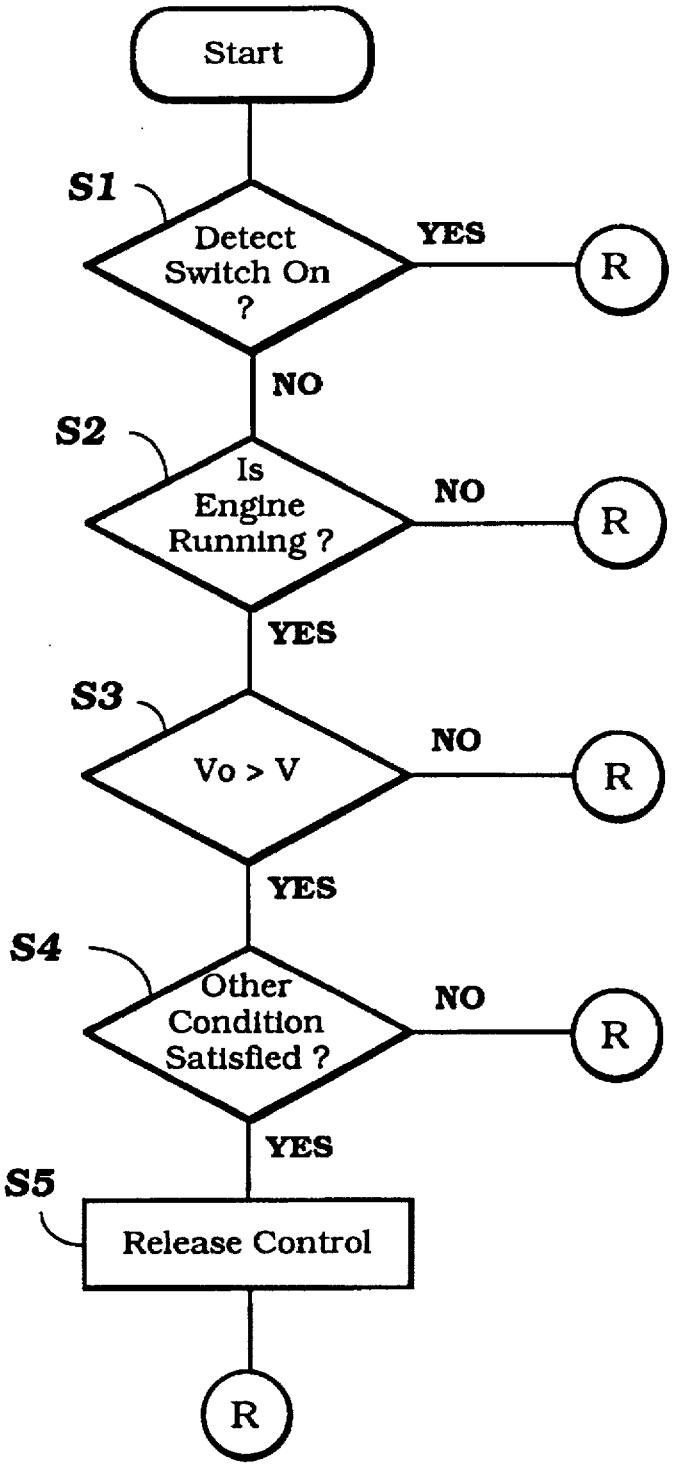
FIG. 7 is a block diagram of a control routine which may be utilized in conjunction with the calculated throttle valve angle in accordance with an embodiment of the invention.

Therefore, the program operates in accordance with the control routine shown in FIG. 7. As seen in FIG. 7, the program starts and then moves to the step S1 to determine if the defect switch 76 is on, indicating a normal condition, or off, indicating an abnormal condition. If the defect switch 76 is in its on or normal mode, the program merely repeats.

If, however, the defect switch 76 is not on, then the program moves to the step S2 so as to see if the engine is running. If the engine is not running, the program merely repeats.

If, however, at the step S2 it is determined that the engine is running, then the program moves to the step S3 so as to compare the angle of opening of the throttle valve V is less than a predetermined throttle opening $V_0$. This angle $V_0$ is the angle of throttle opening below which cylinder disabling is not desired. If the throttle opening is not lower than this amount, then the program repeats and the cylinder disabling is continued.

If, however, at the step S3 it is determined that the throttle valve opening is less than a predetermined amount, then the program moves to the step S4 to determine if the other conditions which may be required to return to normal operation are met. If they are not, the program repeats and the disabling is maintained. If, however, the other conditions are present at the step S4, the program then moves to the step S5 so as to release the disabling control. The program then repeats.

Obviously, this is just one of the many uses that this system for determining throttle angle position can be utilized.

In the foregoing description, the throttle position has been determined by measuring the angle of rotation of the timer ring 53. However, it should also be apparent that other ways of determining throttle angle from movement of the throttle and spark control mechanism may be employed. For example, a position detector, indicated generally by the reference numeral 101 and as shown in FIG. 1, may be mounted on the cylinder block portion 19 in proximity to the spark control lever 66. This detector can function to provide an indication of the angular position of the spark control lever 66, and if this is utilized, it is then not necessary to employ the crankshaft position sensor 73. Alternatively, a potentiometer may be mounted on the spark control mechanism 36 for providing the signal for indicating the position of the throttle valve.

Thus, from the foregoing description it should be readily apparent that the described embodiments provide a very effective way in which the throttle position may be determined without actually employing a throttle position detector. Of course, the foregoing description is that of a preferred embodiment of the invention, and various changes and modifications may be made without departing from the spirit and scope of the invention, as defined by the appended claims.

What is claimed is:

1. An engine control comprising an internal combustion engine having at least one combustion chamber, an induction system for delivering a charge to said combustion chamber, a throttle valve in said induction system for controlling the flow therethrough, a spark plug for firing a charge in said combustion chamber, an engine output shaft driven by the combustion in said combustion chamber, an ignition system for firing said spark plug, said ignition system including a pulser coil associated with said engine output shaft for providing a triggering pulse for said ignition system, a spark control means comprising a linkage system for moving said pulser coil about the axis of rotation of said output shaft in response to the position of said throttle valve, and means for computing the position of said throttle valve from the degree of rotation of said pulser coil about said axis.

2. An engine control as set forth in claim 1, wherein the means for measuring the angular rotation of the pulser coil relative to the crankshaft axis comprises a position detector for detecting the angular position of the crankshaft and a comparator for comparing the output of the pulser coil with the measured position of the crankshaft.

3. An engine control as set forth in claim 1, wherein the means for determining the position of the pulser coil comprises means for measuring the movement of an actuating element of the interconnecting linkage.

4. An engine control as set forth in claim 1, wherein the linkage system comprises a first rotatably supported throttle actuating element and a second coaxial, rotatably supported spark timing lever and means for pivotally connecting said spark timing lever to a timer plate upon which the pulser coil is mounted.

5. An engine control as set forth in claim 4, wherein the means for measuring the angular rotation of the pulser coil relative to the crankshaft axis comprises a position detector for detecting the angular position of the crankshaft and a comparator for comparing the output of the pulser coil with the measured position of the crankshaft.

6. An engine control as set forth in claim 4, wherein the means for determining the position of the pulser coil comprises means for measuring the movement of an actuating element of the interconnecting linkage.

7. An engine control as set forth in claim 1, further including means for controlling an engine running condition in response to at least throttle valve angle and means for utilizing the output of the calculating means for providing the throttle angle signal to said engine control.

8. An engine control as set forth in claim 7, wherein the means for measuring the angular rotation of the pulser coil relative to the crankshaft axis comprises a position detector for detecting the angular position of the crankshaft and a comparator for comparing the output of the pulser coil with the measured position of the crankshaft.

9. An engine control as set forth in claim 7, wherein the means for determining the position of the pulser coil comprises means for measuring the movement of an actuating element of the interconnecting linkage.

10. An engine control as set forth in claim 7, wherein the linkage system comprises a first rotatably supported throttle actuating element and a second coaxial, rotatably supported spark timing lever and means for pivotally connecting said spark timing lever to a timer plate upon which the pulser coil is mounted.

11. An engine control as set forth in claim 10, wherein the means for measuring the angular rotation of the pulser coil relative to the crankshaft axis comprises a position detector for detecting the angular position of the crankshaft and a comparator for comparing the output of the pulser coil with the measured position of the crankshaft.

12. An engine control as set forth in claim 10, wherein the means for determining the position of the pulser coil comprises means for measuring the movement of an actuating element of the interconnecting linkage.

13. An engine control method for an internal combustion engine having at least one combustion chamber, an induction system for delivering a charge to said combustion chamber, a throttle valve in said induction system for controlling the flow therethrough, a spark plug for firing a charge in said combustion chamber, an engine output shaft driven by the combustion in said combustion chamber, an ignition system for firing said spark plug, said ignition system including a pulser coil associated with said engine output shaft for providing a triggering pulse for said ignition system, a spark control means comprising a linkage system for moving said pulser coil about the axis of rotation of said output shaft in response to the position of said throttle valve, said method comprising the steps of computing the position of said throttle valve from the degree of rotation of said pulser coil about said axis and using the computed position for engine control.

14. An engine control method as set forth in claim 13, wherein the measuring of the angular rotation of the pulser coil relative to the crankshaft axis utilizes a position detector for detecting the angular position of the crankshaft and a comparator for comparing the output of the pulser coil with the measured position of the crankshaft.

15. An engine control method as set forth in claim 13, wherein determining of the position of the pulser coil comprises measuring the movement of an actuating element of the interconnecting linkage.

16. An engine control method as set forth in claim 13, wherein the linkage system comprises a first rotatably supported throttle actuating element and a second coaxial, rotatably supported spark timing lever and means for pivotally connecting said spark timing lever to a timer plate upon which the pulser coil is mounted.

17. An engine control method as set forth in claim 16, wherein the angular rotation of the pulser coil relative to the crankshaft axis is measured by a position detector for detecting the angular position of the crankshaft and a comparator for comparing the output of the pulser coil with the measured position of the crankshaft.

18. An engine control method as set forth in claim 16, wherein the position of the pulser coil is computed by measuring the movement of an actuating element of the interconnecting linkage.

19. An engine control method as set forth in claim 13, further including controlling an engine running condition in response to at least throttle valve angle and utilizing the output of the pulser coil calculation means for providing the throttle angle signal for the engine control.

20. An engine control method as set forth in claim 19, wherein the position of the pulser coil relative to the crankshaft axis is computed by detecting the angular position of the crankshaft and comparing the output of the pulser coil with the measured position of the crankshaft.

21. An engine control method as set forth in claim 19, wherein the position of the pulser coil is computed by measuring the movement of an actuating element of the interconnecting linkage.

* * * * *